United States Patent [19]

Kuwahara

[11] Patent Number: 4,843,652

[45] Date of Patent: Jul. 4, 1989

[54] TOWEL GLOVE

[76] Inventor: Mark E. Kuwahara, 27 St. Vincent, Laguna Niguel, Calif. 92677

[21] Appl. No.: 222,511

[22] Filed: Jul. 21, 1988

[51] Int. Cl.[4] ..... A41D 19/00

[52] U.S. Cl. ..... 2/167; 2/159; 2/158

[58] Field of Search ..... 2/159, 161 A, 162, 163, 2/164, 167, 171, 158

[56] References Cited

U.S. PATENT DOCUMENTS

| | | | |
|---|---|---|---|
| 482,647 | 9/1892 | Obear | 2/158 |
| 1,434,854 | 11/1922 | Stall | 2/171 |
| 3,421,160 | 1/1969 | Domenico | 2/159 |
| 3,739,400 | 6/1973 | Colehower | 2/161 R |
| 3,787,897 | 1/1974 | Sabin | 2/167 |
| 4,330,887 | 5/1982 | White | 2/158 |
| 4,751,749 | 6/1988 | Cowhey | 2/167 |

FOREIGN PATENT DOCUMENTS

| | | | |
|---|---|---|---|
| 165734 | 10/1955 | Australia | 2/158 |
| 1328063 | 4/1963 | France | 2/158 |
| 1583181 | 1/1981 | United Kingdom | 2/158 |
| 2113977 | 8/1983 | United Kingdom | 2/158 |

*Primary Examiner*—Werner H. Schroeder
*Assistant Examiner*—D. Biefeld
*Attorney, Agent, or Firm*—Irving Keschner

[57] ABSTRACT

A glove having an open mesh back portion, the front portion of the glove comprising a layer of foam sandwiched between layers of absorbing material. The glove provides easy access for wiping perspiration from the face and body of runners, exercise enthusiasts or other active persons.

3 Claims, 1 Drawing Sheet

FIG. 1
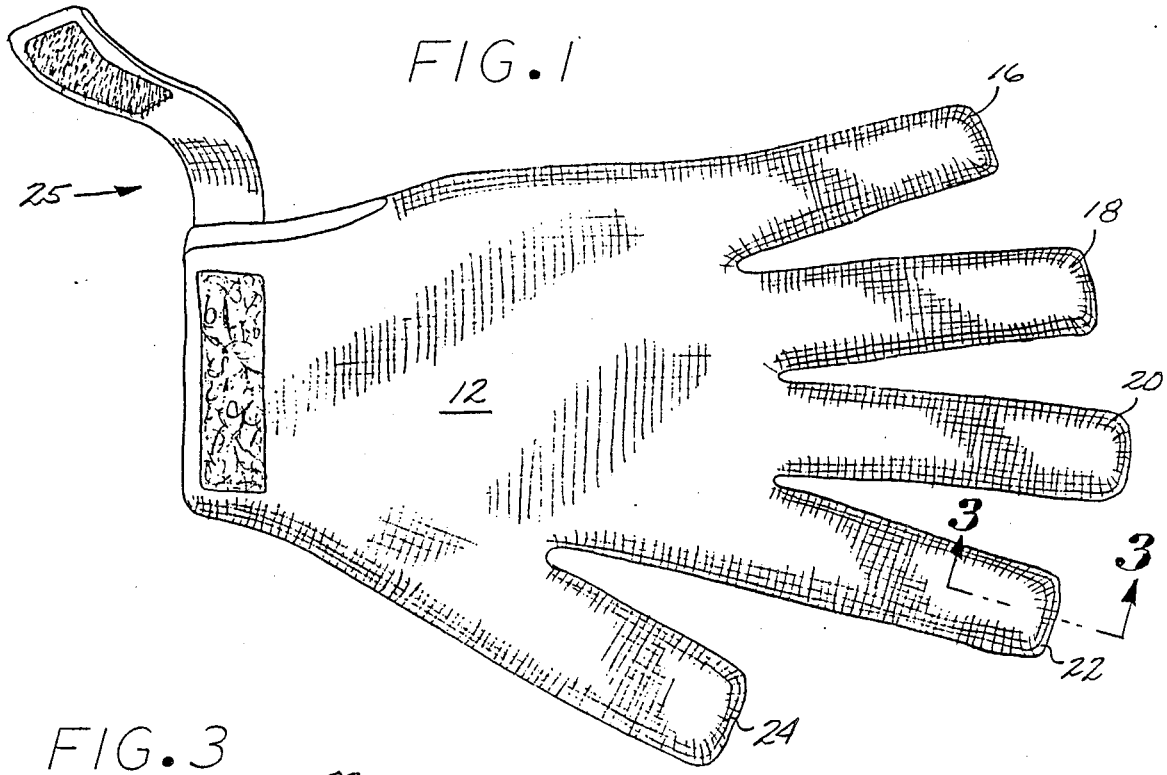
FIG. 3
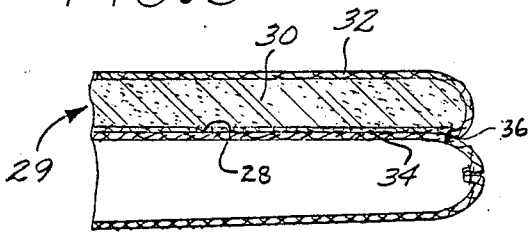
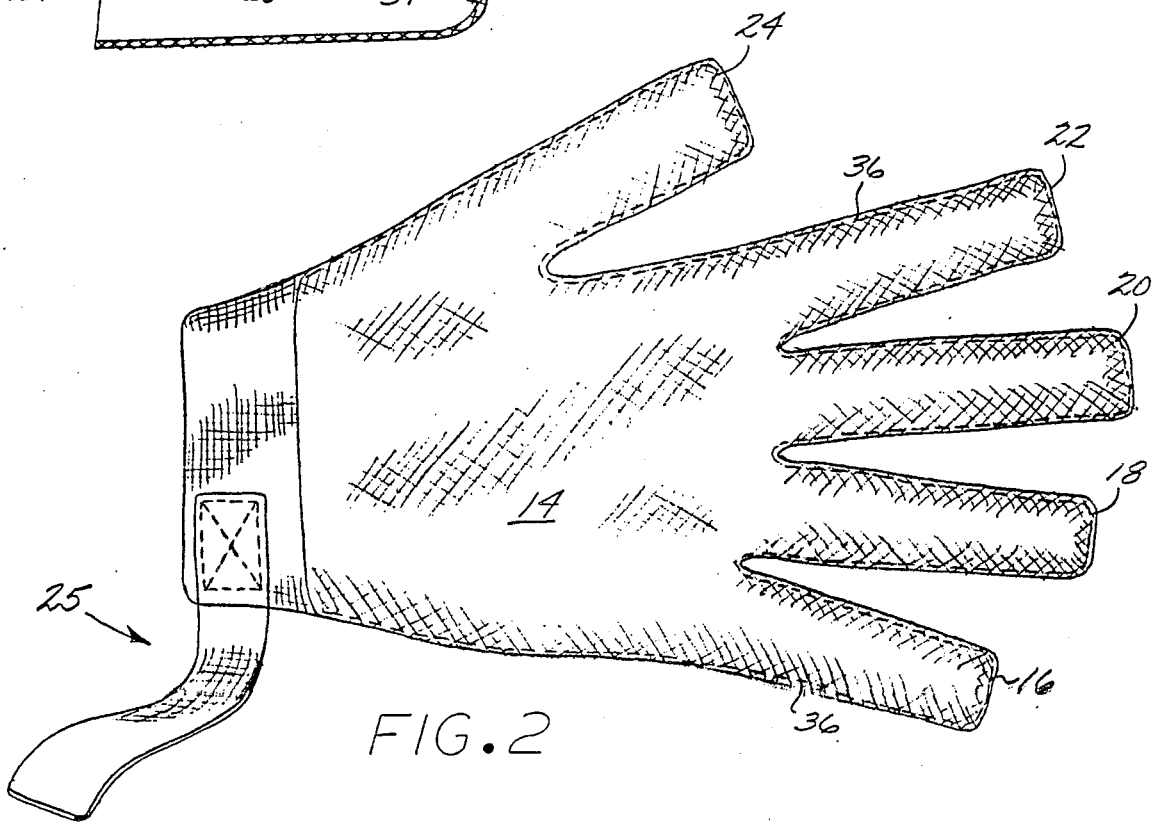
FIG. 2

TOWEL GLOVE

BACKGROUND OF THE INVENTION

1. Field of the Invention

The present invention relates to a new and improved glove which incorporates an accessible moisture absorption member thereon.

2. Description of the Prior Art

A common sight in recent years has been persons engaged in various athletic endeavors having a towel or other moisture absorption member on or near the person performing. For example, runners or joggers typically carry a towel on their persons during the run for wiping perspiration from the face and body. Similarly, those exercising in a health facility, for example, generally have loose wash cloths or towels available to wipe perspiration from the face and body Wrist bands made of knitted terry cloth have been used for many years by tennis players, primarily for preventing perspiration from moistening the hand gripping the racket and secondarily for wiping the wearer's brow. In any event, the wrist band has limited absorption capability.

What would be desired is to provide a perspiration absorbant accessory for runners or the like which can be easily and securely carried by the user, which is easily accessible without interfering with the user's concentration and has a relatively large absorbant area.

As will be set forth hereinbelow, the present invention is directed to a glove which incorporates these features. Gloves for various functions have been available for many years. For example, U.S. Pat. No. 3,739,400 to Colehower discloses a work glove which is reversible so as to permit its being worn on either the right hand or the left hand, the glove being fabricated from knitted terry cloth fabric; U.S. Pat. No. 3,173,150 to Mohler discloses a glove liner comprising a layer of flexible, cellular foam material secured between an inner fabric liner and an outer fabric ply, a protective coating being applied over the outer fabric ply; and U.S. Pat. No. 3,787,897 to Sabin et al discloses a worker's glove, the back portion comprising a mesh material for ventilation purposes. None of the described gloves have the desired features previously noted.

SUMMARY OF THE PRESENT INVENTION

The present invention provides a glove having an open mesh back portion, the front portion of the glove comprising a layer of foam sandwiched between layers of absorbant material.

The glove of the present invention provides a perspiration absorbant accessory for runners or the like which is easily and securely carried by the user, is easily accessible without interfering with the user's concentration, and which has a relatively large absorbant area.

DESCRIPTION OF THE DRAWING

For a better understanding of the invention as well as other objects and further features thereof, reference is made to the following description which is to be used in conjunction with the accompanying drawing wherein:

FIG. 1 is a perspective view showing the front portion of the glove made in accordance with the teachings of the present invention;

FIG. 2 is a perspective view showing the back portion of the glove made in accordance with the teachings of the present invention; and FIG. 3 is a cross-sectional view along line 3—3 of FIG. 1.

DETAILED DESCRIPTION OF THE INVENTION

Referring first to FIGS. 1 and 2, a perspective view of glove 10 formed in accordance with the teachings of the present invention is illustrated. Glove 10 includes a palm portion 12, a back portion 14, and finger stalls 16, 18, 20, 22 and 24. As described herein, the front portion of a glove is defined to include the palm portion and the front surface of the finger stalls. Although glove 10 is shown with five finger stalls, the present invention is adaptable to other glove configurations, such as mitten-style gloves.

In the preferred embodiment, glove 10 comprises an underlying glove which incorporates back portion 14, and a front portion which includes a palm portion, and a plurality of finger stalls which are essentially coextensive with the finger stalls 16, 18 . . . 24. The surface of the finger stall 22 of the underlying glove is noted by reference number 28 in FIG. 3. The underlying glove comprises a conventional handball or golf glove available in many stores. These gloves are typically fabricated from leather and have a cotton net material forming the back portion 14. A Velcro brand closure means 25 is provided to secure glove 10 to the wrist of a user. It should be noted that glove 10 can also be fabricated without the necessity of an underlying glove, composite 29, referred to hereinafter with reference to FIG. 3, being affixed to a mesh backing.

As shown in the cross-sectional view of FIG. 3, a multi-layer composite material 29 is affixed to the surface of the underlying glove in a manner such that it overlies the finger stalls/palm portion thereof and forms palm portion 12 and finger stalls 16, 18 . . . 24 of glove 10. Composite 29 comprises a layer of low density foam 30, typically 0.25 inch thick, sandwiched between layers of absorbent material 32 and 34, such as heavy knitted terrycloth. Although a low density foam layer 30 is desirable for both absorbancy and comfort purposes, the layer could be eliminated and either a single terrycloth layer or a plurality of terrycloth layers could be utilized (other high absorbancy materials can be utilized instead of terrycloth).

In accordance with the preferred method of manufacturing glove 10, the composite material 29 is first made in sheet form by providing lengths of knitted terry cloth and bonding the lengths to opposite surfaces of the foam layer. This may be accomplished by use of a suitable adhesive. The thickness of the foam layer can be varied depending upon the amount of absorption that is required. Blanks are stamped or cut from the composite corresponding to the outline of the front portion of the underlying glove, aligned with the front portion of the underlying glove, and a line of stitching 36 is applied around the periphery of the glove, including the finger stall area but excluding the wrist area. Alternately, blanks are stamped or cut from composite material corresponding to the front of a mesh backing material having a number of finger stalls, and a line of stitching is provided to affix the blank to the mesh backing.

Although terry cloth is the preferred material to use as layers 32 and 34 due to its high absorbancy, other material can be used, such as cotton. A sponge material is preferably used as foam layer 30. Further, other underlying glove or mesh backing shapes can be used, the only requirement being that composite 28 can be secured to the front portion thereof.

The present glove configuration provides significant advantages over current techniques for wiping perspiration from the head and body. In particular, the towel glove is easily portable and accessible and allows a user to concentrate on the activity without worrying about the toweling procedure. The towel glove is sufficiently absorbant to meet user needs.

While the invention has been described with reference to its preferred embodiment, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A glove construction comprising a glove shaped back portion and a glove shaped front portion formed of a composite material, said composite material being affixed to said front portion such that it covers substantially the entire area of said front portion in manner such that at least one individual finger stall for receiving the finger of a hand when the glove is worn is provided, said composite material comprising a layer of foam material between first and second layers of terry cloth.

2. A glove of claim 1 wherein said foam material comprises a sponge.

3. The glove of claim 2 wherein said back portion comprises a mesh material.

* * * * *